US008319131B2

(12) United States Patent
Chen et al.

(10) Patent No.: US 8,319,131 B2
(45) Date of Patent: Nov. 27, 2012

(54) DEVICE FOR SWITCHING AN ELECTRICAL SWITCH ON AND OFF

(75) Inventors: De Zhou Chen, Wuix (CN); Xin Gao Duan, Changshu (CN); Da Yi Li, Zhenjiang (CN); Di Nan Li, Suzhou (CN)

(73) Assignee: Siemens Aktiengesellschaft, Munich (DE)

( * ) Notice: Subject to any disclaimer, the term of this patent is extended or adjusted under 35 U.S.C. 154(b) by 207 days.

(21) Appl. No.: 12/824,524

(22) Filed: Jun. 28, 2010

(65) Prior Publication Data

US 2010/0326805 A1 Dec. 30, 2010

(30) Foreign Application Priority Data

Jun. 29, 2009 (CN) ..... 2009 1 0151503

(51) Int. Cl.
*H01H 25/00* (2006.01)

(52) U.S. Cl. ..... 200/337

(58) Field of Classification Search ..... 200/337, 200/570, 17 R, 6 R, 6 B, 6 BA, 19.01, 19.03, 200/19.04, 19.05, 19.07, 19.13, 19.18, 19.2, 200/36, 38 R, 33 B, 564, 568, 569, 307, 329, 200/336, 334, 500, 501, 6 C See application file for complete search history.

(56) References Cited

U.S. PATENT DOCUMENTS

| | | | | |
|---|---|---|---|---|
| 2,978,547 | A * | 4/1961 | Nash | 200/5 A |
| 4,190,755 | A * | 2/1980 | Rogers | 200/334 |
| 5,834,717 | A * | 11/1998 | Neumeyer et al. | 200/17 R |
| 7,679,018 | B2 | 3/2010 | Kolmonen et al. | |
| 2004/0011631 | A1 * | 1/2004 | Baertl | 200/17 R |
| 2008/0035464 | A1 | 2/2008 | Kolmonen et al. | |

FOREIGN PATENT DOCUMENTS

| | | |
|---|---|---|
| CN | 1910715 A | 2/2007 |
| EP | 1406278 A2 | 4/2004 |

* cited by examiner

*Primary Examiner* — Edwin A. Leon

(74) *Attorney, Agent, or Firm* — Harness, Dickey & Pierce, P.L.C.

(57) ABSTRACT

A device is disclosed for switching an electrical switch on and off, with a drive shaft and an output shaft. The drive shaft and the output shaft run transversely with respect to one another and interact in such that a rotation of the drive shaft entails a rotation of the output shaft, the drive shaft being rotatable between an ON position and an OFF position, and the output shaft being rotatable between a switch-on position and a switch-off position. The output shaft is connected to the switch which can be switched to the switch-on and the switch-off position as a result of the rotation of the output shaft. The drive shaft and the output shaft are connected to one another via a displaceable sliding element which, during the rotation of the drive shaft, is displaced, and the output shaft is rotated by the sliding element in the course of displacement.

5 Claims, 4 Drawing Sheets

DEVICE FOR SWITCHING AN ELECTRICAL SWITCH ON AND OFF

PRIORITY STATEMENT

The present application hereby claims priority under 35 U.S.C. §119 on Chinese patent application number CN 200910151503.8 filed Jun. 29, 2009, the entire contents of which are hereby incorporated herein by reference.

FIELD

At least one embodiment of the invention generally relates to a device for switching an electrical switch on and off.

BACKGROUND

A device for switching a switch on and off is known from CN1910715A and is used for controlling the switching states ON, OFF and test of the switch. Conventional devices comprise a housing, a drive shaft mounted in the housing and an output shaft set in motion by this drive shaft.

In particular, CN1910715A lays open a changeover device having the set-up mentioned. In this device, a cam wheel is located on the drive shaft, and a cylinder is located on the output shaft, and, as a result of the mutual coordination of the cam wheel part and cylinder, it is possible to implement the fixing of the position by means of the rotation of the drive shaft or output shaft. On account of the direct rotation of the output shaft by the drive shaft and of the absence of an amplifier module lying between them, the efficiency of the transmission of the force moment of this device during actuation is very low, and therefore a very high force moment is required for actuation.

SUMMARY

At least one embodiment of the invention provides a device for switching a switch on and off, which effectively switches the switch into the positions ON and OFF and at the same time has a simple set-up and force-saving actuation.

At least one embodiment provides a device for switching an electrical switch on and off, with a drive shaft and with an output shaft, the drive shaft and the output shaft running transversely with respect to one another and cooperating in such a way that a rotation of the drive shaft entails a rotation of the output shaft, the drive shaft being rotatable between an ON position and an OFF position, and the output shaft being rotatable correspondingly thereto between a switch-on position and a switch-off position, the output shaft being connected to the switch which can be switched on into the switch-on position as a result of the rotation of the output shaft and can be switched off into the switch-off position by rotation.

In at least one embodiment, the drive shaft and the output shaft are connected to one another via a displaceable sliding element which is displaced during the rotation of the drive shaft, the output shaft being rotated about its axis of rotation by the sliding element in the course of displacement.

Advantageously, the sliding element is displaceable along an imaginary straight line transversely with respect to the drive shaft and also with respect to the output shaft.

It is simple in technical terms if two stop elements are arranged fixedly on the sliding element, a radial projection is formed on the drive shaft and extends between the two stop elements, and, during the rotation of the drive shaft, the projection in each case presses against a stop element and at the same time displaces the sliding element.

Further, it is simple in technical terms if two cams are arranged fixedly on the sliding element, a radial pivoting arm is arranged fixedly on the output shaft and extends between the two cams, a cam presses in each case against the projection of the output shaft in the course of the displacement/displacement travel, and rotates the output shaft into the switch-on position in one direction of displacement and into the switch-off position in the other opposite direction of displacement.

Switching takes place independently of the actuation force if the sliding element is connected to a spring mechanism which automatically pushes the sliding element further on after the latter has passed a tipping point.

In a simple version of the spring mechanism, the latter includes a spring assembly which is connected to the sliding element via a connecting rod.

In other words, the device according to at least one embodiment of the invention comprises a drive shaft, a sliding element driven by the drive shaft and an output shaft driven by the sliding element. A first drive shaft cam and a second drive shaft cam are located on the drive shaft on the same radial cross section. A pivoting arm which projects in the radial direction is located on the output shaft. A drive shaft orifice, a first cam, a second cam, a third cam, a switch-on cam of the output shaft and a switch-off cam of the output shaft are located on the sliding element. The drive shaft passes through the drive shaft orifice. The switch-on cam of the output shaft can drive the pivoting arm of the output shaft and bring the output shaft into the ON position. The switch-off cam of the output shaft can drive the pivoting arm of the output shaft and bring the output shaft into the OFF position. The first cam can butt against the first drive shaft cam and secure the switch in the ON position. The second cam can butt against said second drive shaft cam and secure the switch in the OFF position. The third cam can butt against said second drive shaft cam and secure the switch in the test position.

In particular, the switch-on cam of the output shaft and the switch-off cam of the output shaft are provided on the sliding element on half of the margin of the drive shaft orifice, while the first cam, the second cam and the third cam are provided on the other half of the margin of the drive shaft, in order to avoid the situation where mutual disturbances arise between the actuation of the sliding element by the drive shaft and the actuation of the output shaft by the sliding element.

The device can utilize the interaction of the drive shaft and cams on the sliding element, can effectively restrict the switch in the ON, OFF and test positions and at the same time, by the interaction of the cams and pivoting arm of the output shaft, can reduce the force moment for the actuation of the switch by utilizing the action of the pivoting arm, with the result that a force-saving and reliable control of the actuation of the switch is implemented.

BRIEF DESCRIPTION OF THE DRAWINGS

The following figures offer merely a diagrammatic description and explanation of the invention and in no way restrict the scope of the latter.

mum

DETAILED DESCRIPTION OF THE EXAMPLE EMBODIMENTS

Figure 1:
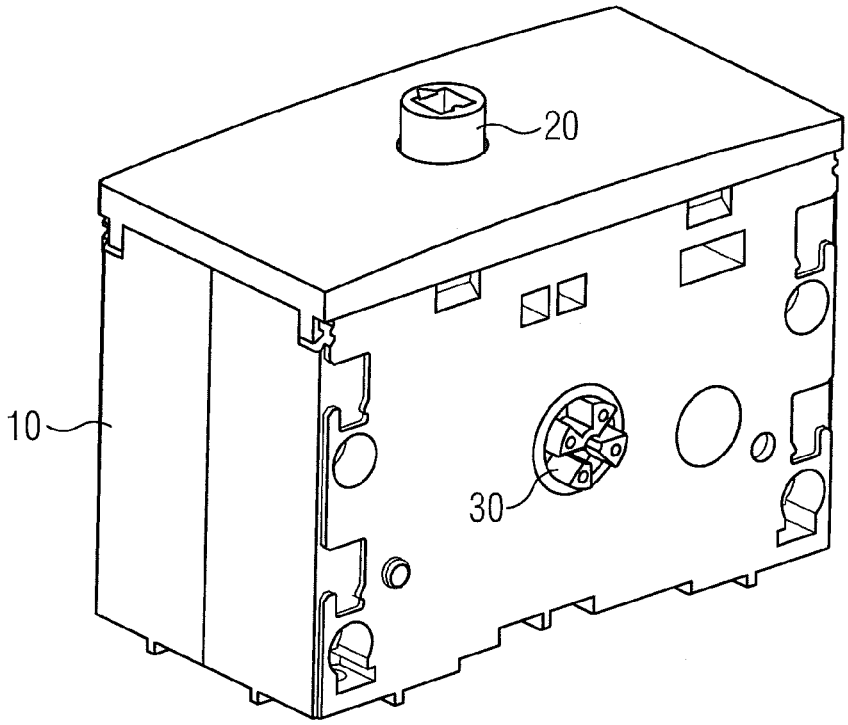
FIG. 1 shows a diagrammatic illustration of the outer set-up of the device.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

According to the figures, the device for switching an electrical switch on and off has a drive shaft 20 and an output shaft 30. The drive shaft 20 and the output shaft 30 run transversely with respect to one another and cooperate in such a way that a rotation of the drive shaft 20 entails a rotation of the output shaft 30. In this case, the drive shaft 20 is rotatable between an ON position and an OFF position and the output shaft 30 is rotatable correspondingly thereto between an ON position and an OFF position. The output shaft 30 is connected to the switch which can be switched on into the switch-on position as a result of the rotation of the output shaft 30 and can be switched off into the switch-off position by rotation.

According to an embodiment of the invention, the drive shaft 20 and the output shaft 30 are connected to one another via a displaceable sliding element 40 which is displaced during the rotation of the drive shaft 20, specifically, depending on the direction of rotation, in one direction or in the other opposite direction, along an imaginary straight line transversely with respect to the drive shaft 20 and also with respect to the output shaft 30. The output shaft 30 is rotated about its axis of rotation by the sliding element 40 in the course of displacement. For this purpose, two stop elements 47, 48, in the interspace of which extends a radial projection 23 formed on the drive shaft 20, are arranged fixedly on the sliding element 40.

During the rotation of the drive shaft 20, the projection 23 presses in each case against a stop element 47 or 48, with the result that it displaces a sliding element 40 in one direction or in the other opposite direction, depending on the direction of rotation. In order to rotate the output shaft 30 about its axis of rotation, two cams 45, 46 are arranged fixedly on the sliding element 40, and a radial pivoting arm 31 is arranged fixedly on the output shaft 30 and extends between the two cams 45, 46 or engages between the two cams. In the course of the displacement or displacement travel, in each case a cam 45 or 46 presses against the pivoting arm 31 and thus rotates the output shaft 30 into the switch-on position and into the switch-off position, depending on the direction of displacement.

Figure 5:
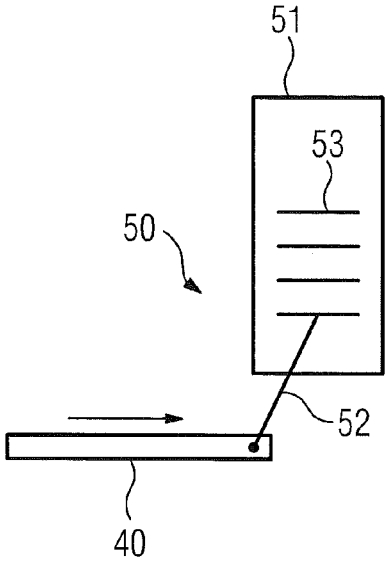
FIGS. 5 and 6 show the spring mechanism according to FIG. 4 as a diagrammatic illustration.
Figure 6:
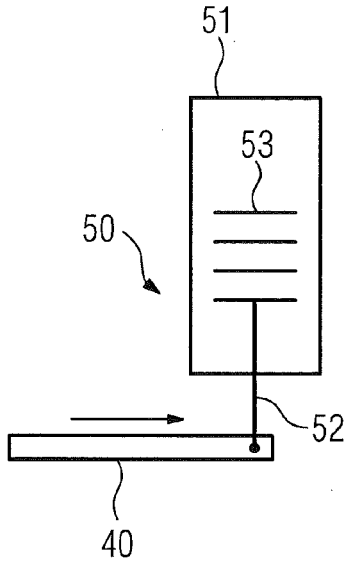

The sliding element 40 is connected to a spring mechanism 50 (see FIG. 4) which automatically displaces the sliding element 40 into the ON position or, in the case of displacement in the other direction, into the OFF position after it has passed a tipping point. The spring mechanism 50 comprises a spring assembly 51 which includes compression springs 53 and which is connected in an articulated manner to the sliding element 40 via a connecting rod 52 so as to be pivotable in the direction of displacement (direction of the arrow in FIGS. 5 and 6). FIGS. 5 and 6 show diagrammatically the interaction of the sliding element 40, connecting rod 52 and the spring assembly 51. In FIG. 6, the tipping point is reached, after the overshooting of which the spring assembly 51 pushes the sliding element 40 further on by way of the spring forces.

In other words:

FIG. 1 shows a device for switching an electrical switch on and off. The device has a housing 10, a drive shaft 20 and an output shaft 30 projecting out of two side faces of the housing 10 which stand perpendicularly to one another. The rotation of the drive shaft 20 can be controlled on the basis of the different operating requirements of the switch, whereupon the output shaft 30 is set in rotation. A connection is made by the output shaft 30 to the contact module (not depicted) which is set in motion and brings the switch into the ON, OFF or test position.

Figure 2:
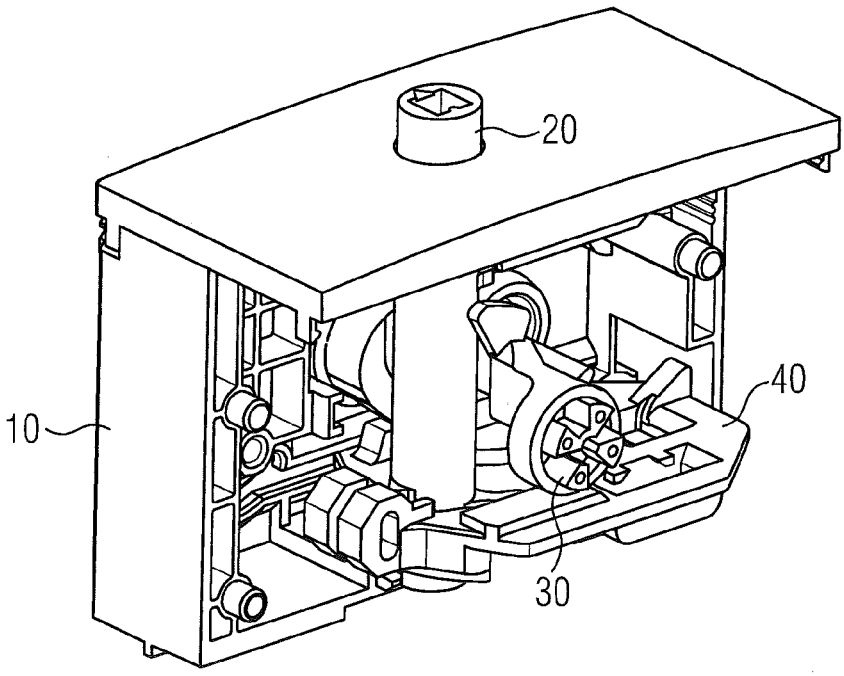
FIG. 2 shows a diagrammatic illustration of the inner set-up of the device according to FIG. 1.

FIG. 2 shows the diagrammatic illustration of the inner set-up of the device, as becomes visible after the demounting of the housing part 10 shown in FIG. 1, the drive shaft 20 being connected to a sliding element (sliding piece, slide) 40, and the output shaft 30 likewise being provided on the sliding element 40. When the drive shaft 20 rotates, the drive shaft 20 causes a shift (and consequently displacement) of the sliding element 40, while the shift in the sliding element 40, in turn, drives the output shaft 30 in rotation, thereby implementing the function whereby the output shaft 30 changes the state of the switch.

Figure 3:
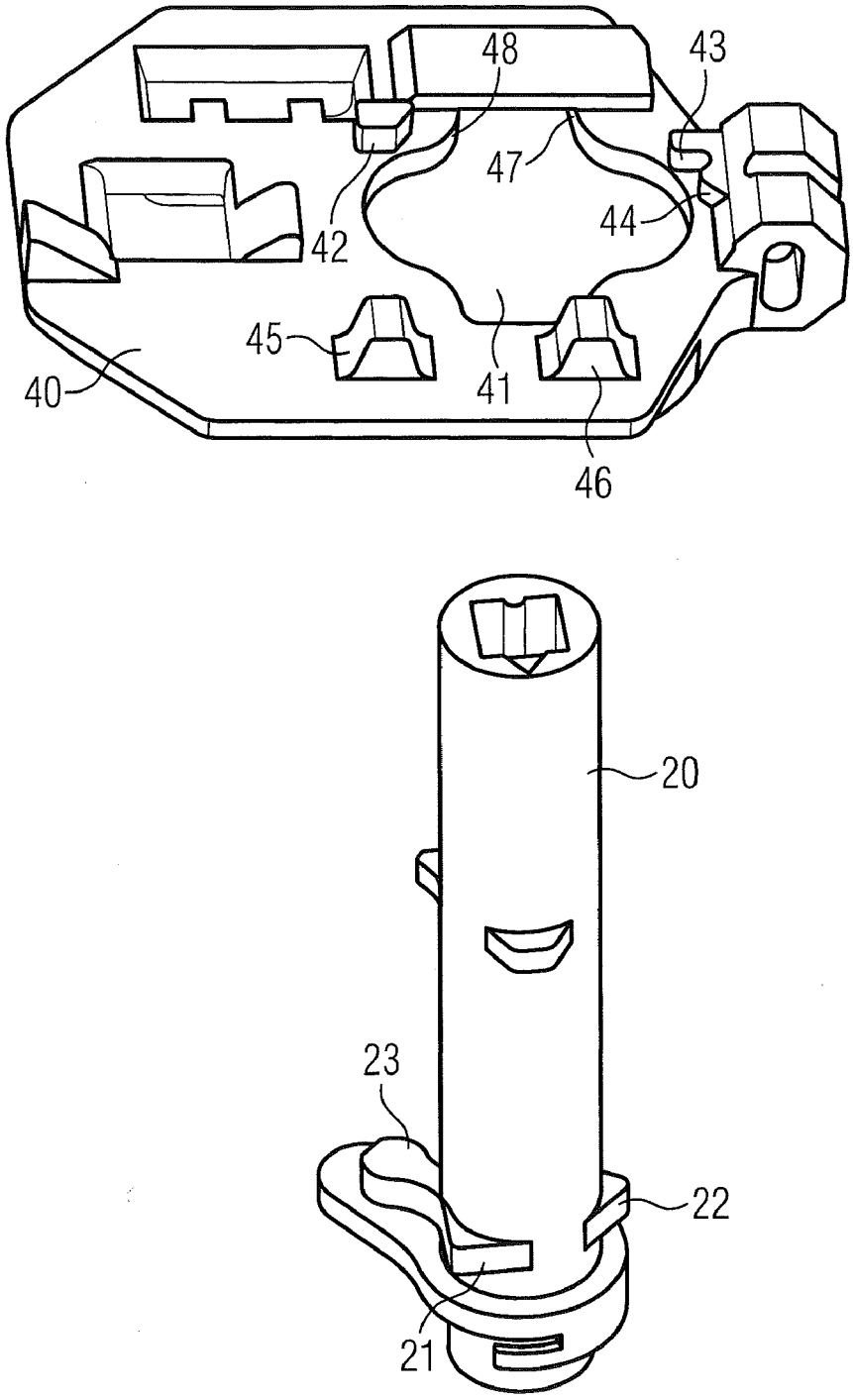
FIG. 3 shows a three-dimensional diagrammatic exploded illustration of the drive shaft and sliding element of the device according to FIG. 1.

FIG. 3 shows a three-dimensional diagrammatic exploded illustration of the drive shaft 20 and sliding element 40. This describes how, in the device, the drive shaft 20 and sliding element 40 implement the locking of the switch in the ON, OFF and test positions.

As illustrated in FIG. 3, a first drive shaft cam 21 and a second drive shaft cam 22 are located on the drive shaft 20. These two cams are located on the same radial cross section of the drive shaft. A drive shaft orifice 41, a first cam 42, a second cam 43, a third cam 44, a switch-on cam 45 of the output shaft 30 and a switch-off cam 46 of the output shaft 30 are located on the sliding element 40. The drive shaft 20 passes through the drive shaft orifice 41.

Figure 4:
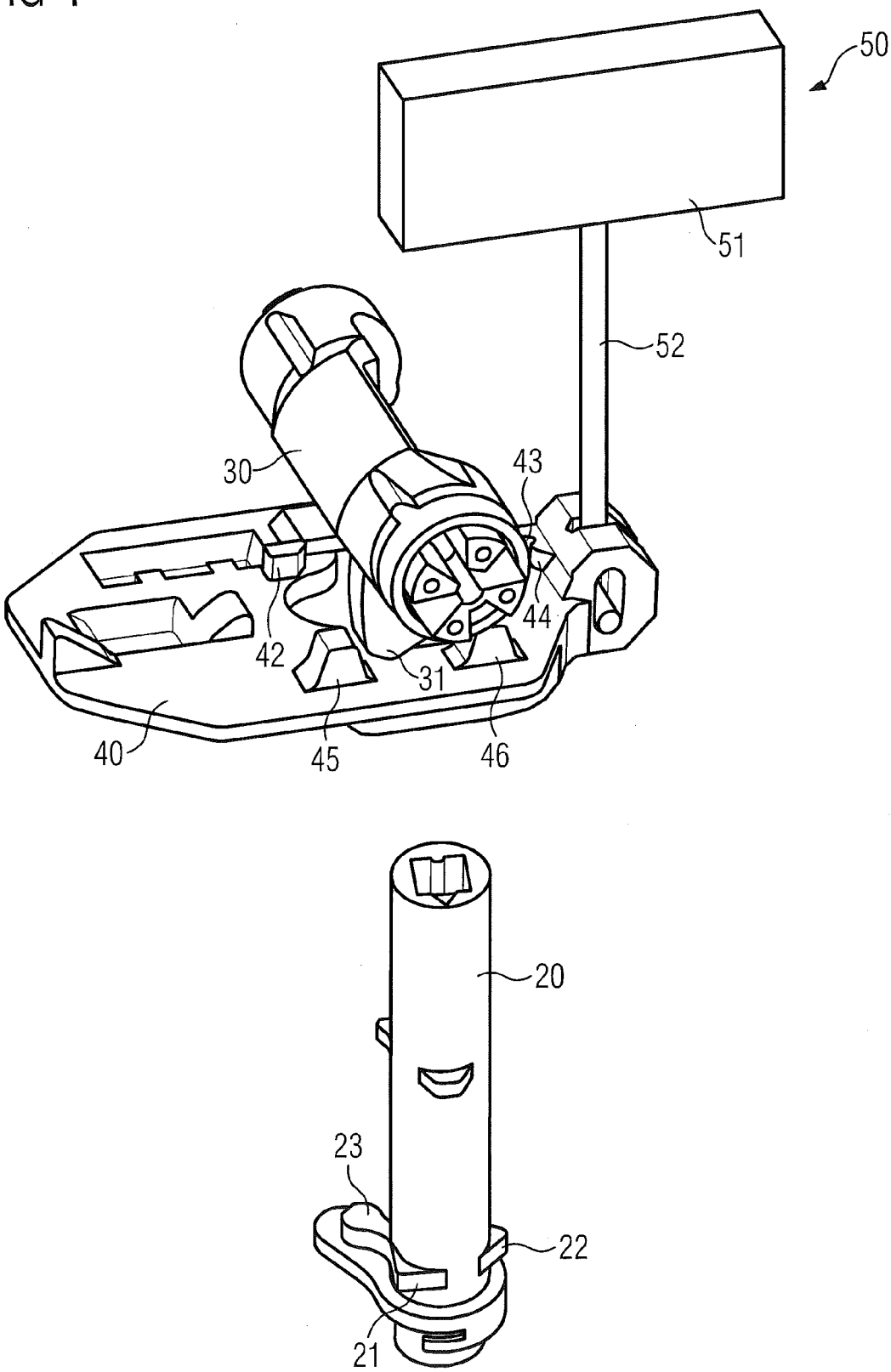
FIG. 4 shows a diagrammatic exploded illustration of the set-up of the drive of the device according to FIG. 1 with a spring mechanism.

FIG. 4 shows a three-dimensional diagrammatic exploded illustration of the drive shaft 20, output shaft 30 and sliding element 40 in the device. The pivoting arm 31 is provided on the output shaft 30. When the drive shaft 20 rotates, the pivoting arm 31 of the output shaft 30 can engage with the switch-on cam 45 of the output shaft 30 or with the switch-off cam 46 of the output shaft 30 and increase the force moment for actuation in order to drive the output shaft 30, with the result that only a very low actuating moment is used for switching the switch on and off.

According to FIG. 4, the first drive shaft cam 21 on the drive shaft 20 butts against the first cam 42 when the drive shaft 20 is rotated and its rotation reaches the ON position, so that it is impossible for the drive shaft 20 to continue to rotate and the drive shaft 20 can be fixed in the ON position. At the same time, in this operation, the sliding element 40 is offset to the left, as depicted, under the action of the drive shaft 20. The switch-on cam 45 of the output shaft on the sliding element 40 moves the pivoting arm 31 of the output shaft 30, so that the output shaft 30 rotates into the ON position. The output shaft 30 causes an action of the contact module, so that the switch closes.

When the drive shaft 20 rotates into the OFF position, the second drive shaft cam 22 on the drive shaft 20 butts against the second cam 43. The drive shaft 20 cannot rotate any further, and the drive shaft 20 can be fixed in the OFF position. At the same time as this, the sliding element 40 is offset to the right, as depicted, under the action of the drive shaft 20. The switch-off cam 46 of the output shaft on the sliding element 40 moves the pivoting arm 31 of the output shaft 30, so that the output shaft 30 rotates into the OFF position. The output shaft 30 moves the contact module, so that the switch opens.

When the drive shaft 20 rotates into the test position, the second drive shaft cam 22 of the drive shaft 20 butts against the third cam 44. The drive shaft 20 does not rotate any further, so that the drive shaft 20 is fixed in the test position. At the same time as this, it is impossible for the force of the drive shaft 20 to exert action upon the sliding element 40. The sliding element 40 is therefore not offset.

As shown in FIGS. 3 and 4, in an example embodiment of this invention, the switch-on cam 45 of the output shaft and the switch-off cam 46 of the output shaft are attached to the sliding element 40 on half of the margin of the drive shaft orifice 41, while the first cam 42, second cam 43 and third cam 44 can be attached on the opposite other half of the margin of the drive shaft. What can be achieved thereby is that that part of the sliding element 40 which actuates the output shaft 30 and that part of the drive shaft 20 which actuates the sliding element 40 are relatively far away from one another. When a relatively simple design is employed in this way, mutual disturbances between the drive shaft 20, the sliding element 40 and the output shaft 30 can be avoided when the device is in operation.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A device for switching an electrical switch on and off, comprising:

a drive shaft; and an output shaft, the drive shaft and the output shaft running transversely with respect to one another and cooperating in such a way that a rotation of the drive shaft entails a rotation of the output shaft, the drive shaft being rotatable between an ON position and an OFF position, and the output shaft being rotatable correspondingly thereto between a switch-on position and a switch-off position, the output shaft being connected to the electrical switch which is switchable on into the switch-on position as a result of the rotation of the output shaft and which is switchable off into the switch-off position by rotation, the drive shaft and the output shaft being connected to one another via a displaceable sliding element which, during the rotation of the drive shaft, is displaced and rotates the output shaft about its axis of rotation in the course of displacement wherein the sliding element is connected to a spring mechanism which automatically pushes the sliding element further on after the sliding element has passed a tipping point.

2. The device as claimed in claim 1, wherein the sliding element is displaceable along an imaginary straight line transversely with respect to the drive shaft and also with respect to the output shaft.

3. The device as claimed in claim 1, wherein two stop elements are arranged fixedly on the sliding element, wherein a radial projection is formed on the drive shaft and extends between the two stop elements, and wherein, during the rotation of the drive shaft, the radial projection, in each case, presses against a stop element and displaces the sliding element.

4. The device as claimed in claim 1, wherein two cams are arranged fixedly on the sliding element, wherein a radial pivoting arm is arranged fixedly on the output shaft and extends between the two cams, and wherein, in the course of the displacement travel, in each case a cam presses against the projection of the output shaft and rotates the output shaft into the switch-on position in one direction of displacement and into the switch-off position in the other opposite direction of displacement.

5. The device as claimed in claim 1, wherein the sliding element includes a spring assembly which is connected to the sliding element in an articulated manner via a connecting rod.

* * * * *